United States Patent [19]

Fortin

[11] Patent Number: 4,860,723

[45] Date of Patent: Aug. 29, 1989

[54] CERAMIC TILE SPACING GAUGE AND TILE HOLDER

[76] Inventor: Conrad Fortin, 534 Main St., Van Buren, Me. 04785

[21] Appl. No.: 148,291

[22] Filed: Jan. 25, 1988

[51] Int. Cl.[4] ..... B26F 3/00; B28D 1/32

[52] U.S. Cl. ..... 125/23 T; 33/32.2; 33/526; 83/879; 225/96

[58] Field of Search ..... 33/518, 526, 527, DIG. 20, 33/32.1, 32.2, 549, 552, 553, 556, 557, 573; 225/96.5; 83/468, 467 A, 467, 441, 743, 744, 745, 207, 212, 268, 278; 125/23 T, 23 C, 23 R; 30/179; 7/163

[56] References Cited

U.S. PATENT DOCUMENTS

| | | | |
|---|---|---|---|
| Re. 32,548 | 11/1987 | Hepworth et al. | 225/96.5 |
| 2,490,989 | 12/1949 | Williams | 125/23 C |
| 2,619,173 | 11/1952 | Crain | 83/468 |
| 2,855,690 | 10/1958 | Marr | 83/13 |
| 3,183,598 | 5/1965 | Parr | 33/527 |
| 3,718,980 | 3/1973 | Poulos | 33/174 G |
| 4,504,003 | 3/1985 | Moody | 125/23 T |

*Primary Examiner*—Frank T. Yost
*Assistant Examiner*—Rinaldi Rada
*Attorney, Agent, or Firm*—Daniel H. Kane, Jr.

[57] ABSTRACT

A tile spacing gauge for gauging the space for a last row of tiles is also a tile holder that is coupled to a tile cutter so that the tile spacing gauge forms an integral component of the tile cutter. Tiles for the last row are held in position at a butting edge of the tile spacing gauge for scoring by the tile cutter along a line set by the tile spacing gauge without requiring an intermediate step of actually measuring and marking the tiles. In the described example, an elongate frame cross arm of the tile spacing gauge is formed with brackets spaced apart at either end. The brackets slideably receive elongate gauge arms in parallel with each other and at right angles to the frame cross arm. Positioning of the gauge arms affords parallel and independent measurement of distances from reference edges on the brackets placed against the second to last row of installed tiles to a boundary. The independent measurements take account of "out of square" wall frames and structures. The butting edge of the tile spacing gauge is adjustable in relation to the reference edge for setting the desired width of the tile grout line. The tile spacing gauge is coupled to a tile cutter at the ends of the elongate gauge arms.

14 Claims, 3 Drawing Sheets

CERAMIC TILE SPACING GAUGE AND TILE HOLDER

TECHNICAL FIELD

This invention relates to ceramic tile spacing measurement gauges for measuring the space or span for a last row of ceramic tiles or tile slabs to be cut and installed on a floor, wall or ceiling surface. In particular the invention relates to a new tile spacing gauge which is also a tile holder that is coupled to a ceramic tile cutter so that the gauge forms an integral component of the tile cutting apparatus for accurately scoring ceramic tiles without the necessity of marking the tiles or tile slabs.

BACKGROUND ART

A variety of tile spacing measurement gauges have been described for use in accurately scoring and cutting the last row of ceramic tiles to be installed on a floor, wall or ceiling surface. These measurement gauges described in the references listed in Applicant's Form PTO-1449 filed concurrently are generally for the purpose only of measuring and marking a cutting line on tiles to be cut, for example as set forth in the Parr U.S. Pat. No. 3,183,598 and the Poulos U.S. Pat. No. 3,718,980, or for guiding a hand held "linoleum knife" as set forth in the Marr U.S. Pat. No. 2,855,690. Typically, the prior art is concerned with flexible linoleum tile rather than the rigid ceramic tile. These references do not describe gauges which also function as an integral component of a ceramic tile cutting machine or apparatus. Nor do these references describe ceramic tile gauges which afford simultaneous independent parallel measurements at spaced apart locations for "out of square" floor, wall and ceiling surfaces.

OBJECTS OF THE INVENTION

It is therefore an object of the present invention to provide a new ceramic tile spacing gauge for measuring the space for a last row of tiles or tile slabs but which also functions as an integral component of a ceramic tile cutter for accurately scoring and cutting tiles according to the gauge setting without the step of measuring and marking the tile or tile slab. The invention assures accurate cutting of ceramic tiles even under temporary lighting of construction conditions.

Another object of the invention is to provide a tile spacing gauge which makes simultaneous but separate, independent and parallel measurements of distance at spaced apart locations between the working reference line of a row of installed tiles and the boundary of a floor, ceiling or wall surface to account and adjust for "out of square" surfaces.

A further object of the invention is to provide a tile spacing gauge with independently adjustable gauge arms having coupling means for coupling the gauge arms to a ceramic tile cutter for use of the tile spacing gauge as a ceramic tile or tile slab holder. By this arrangement the ceramic tiles may be scored directly without the step of measuring and marking the tiles or tile slabs.

DISCLOSURE OF THE INVENTION

In order to accomplish these results the present invention provides a new tile spacing gauge and tile holder having a frame defining a reference edge for placement against a working reference line such as a row of installed tiles. In the preferred example the frame is an elongate frame cross arm having first and second spring tensioned brackets or sockets on either end of the cross arm. The brackets are constructed and arranged for slideably receiving elongate gauge arms in parallel with each other and at right angles to the frame cross arm. The brackets are formed underneath with the reference edge by reference projections. The sliding gauge arms are firmly held in the brackets with a tight spring tension fit.

A feature and advantage of this arrangement is that the elongate gauge arms permit simultaneous parallel but independent measurement of the distances from the reference edge and working reference line to a boundary of the floor, wall or ceiling surface at two spaced apart locations by slideably positioning the gauge arms. The gauge therefore automatically accommodates or adjusts to "out of square" surfaces and lines.

According to the invention, an abutment edge is also provided on the frame providing a butting edge spaced in relation to the reference edge or projections for positioning and aligning tiles or tile slabs to be scored by a tile cutter. In the preferred example embodiment, the butting edge is provided by an abutment panel adjustably mounted on the frame or frame cross arm for variable positioning of the butting edge in relation to the reference edge for accommodating and setting a tile grout line of desired width during scoring and cutting of tiles. Set screws permit adjusting the abutment panel and butting edge, setting the grout line width for the entire job without further adjustment.

The tile spacing gauge is also provided with coupling elements for coupling to a conventionally available tile cutter adapted or retrofitted to receive the tile spacing gauge as an integral component. In the preferred example the coupling elements and coupling are implemented at the end of the gauge arms for example by holes formed in the ends of the gauge arms and pins, posts or knobs retrofitted onto the tile cutter plate. A feature and advantage of this arrangement is that the tiles may be scored along a line defined and set by the positioning of the gauge arms without the intermediate step of measuring and marking the tiles. It is not necessary to mark the tiles or follow a marked line.

The frame cross arm may be formed as a raised bridge between the brackets providing a handle. Spacers may be provided below the gauge arms to avoid tile adhesive applied on a surface. The present invention is suitable for cutting loose or individual ceramic tiles typically in the approximate size ranges for example 4"×4", 6"×6", 8"×8" etc. as well as mounted pregrouted tile sheets typically in the approximate size ranges for example 18"×18" etc. For loose tiles the spacing gauge and tile holder cuts, for example, two 8"×8", three 6"×6" or four 4"×4" tiles according to the dimensions of the frame, etc. Other objects, features and advantages of the invention are apparent in the following specification and accompanying drawing.

DESCRIPTION OF PREFERRED EXAMPLE EMBODIMENTS AND BEST MODE OF THE INVENTION

Figure 1:
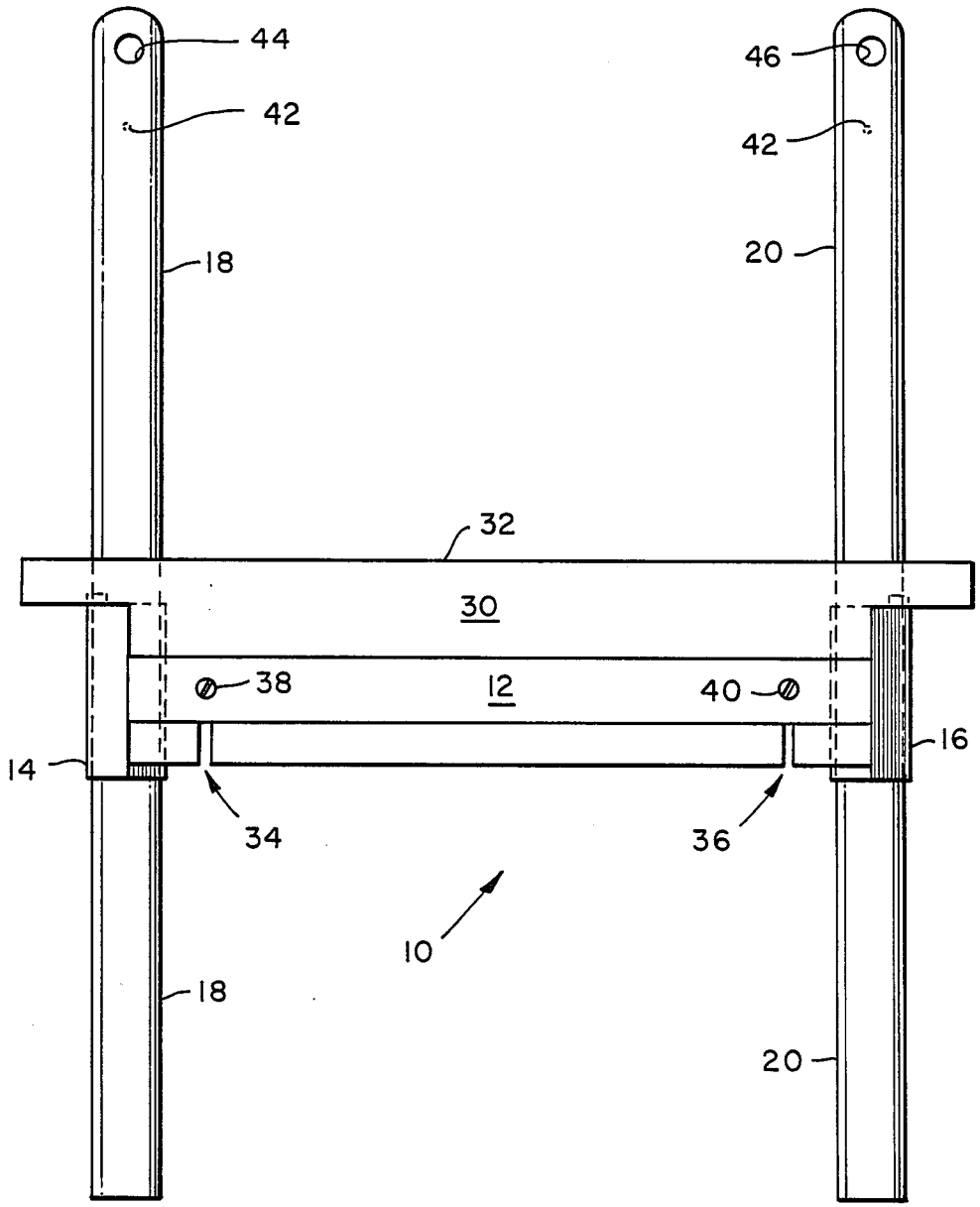
FIG. 1 is a plan view from above of the tile spacing gauge and tile holder.
Figure 2:
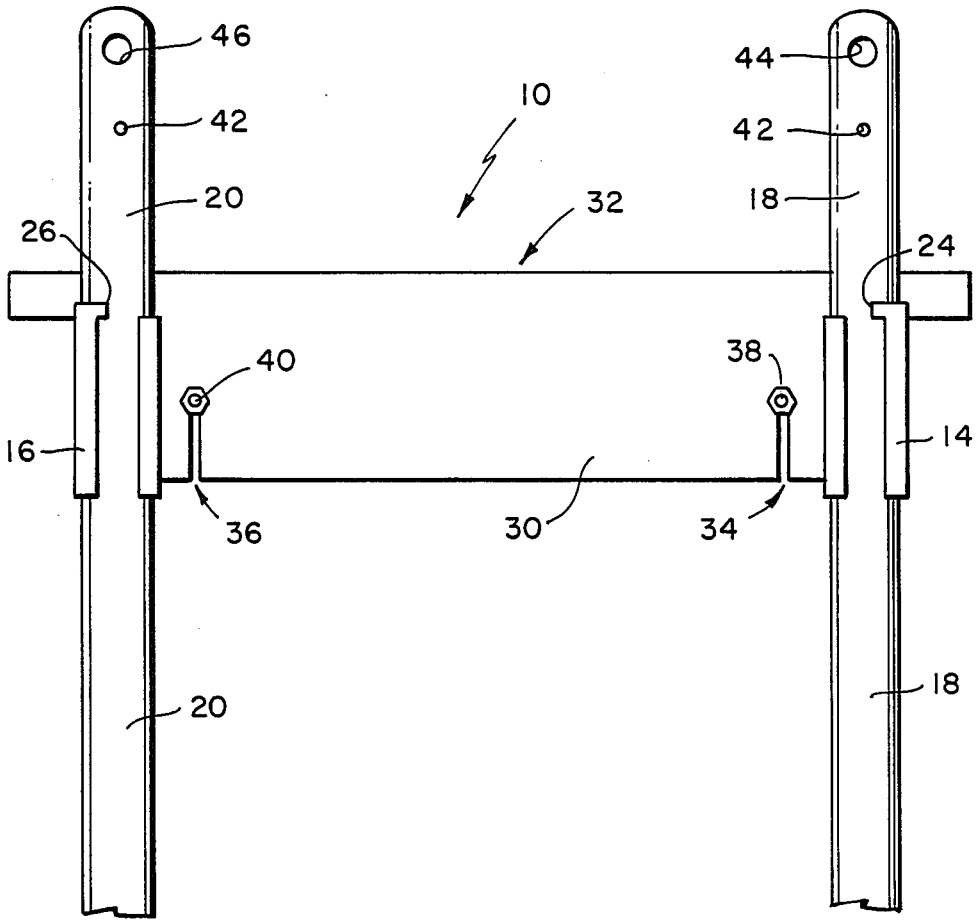
FIG. 2 is a plan view from below of the tile spacing gauge and tile holder.
Figure 3:
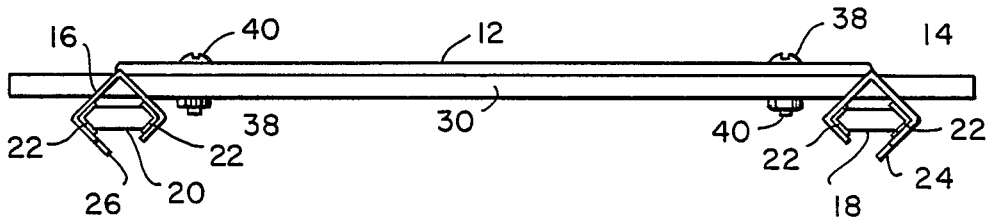
FIG. 3 is an end view of the tile spacing gauge and tile holder.
Figure 4:
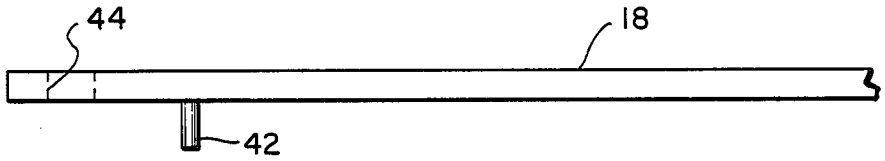
FIG. 4 is a fragmentary side view of the end of a gauge arm batten showing a spacer projection or pin to prevent the arm from falling into adhesive.

A tile spacer gauge 10 according to the present invention is illustrated in FIGS. 1 through 4. The structural support for the gauge is provided by a frame in the form of an elongate frame cross arm 12 with brackets or sockets 14 and 16 at each end. The brackets or sockets 14 and 16 are oriented at right angles to the elongate axis of the cross arm 12. As shown in FIG. 3 the brackets 14 and 16 are spring tensioned brackets constructed and arranged for slideably receiving elongate gauge arms 18 and 20 with a tight tensioned fit. No set screw or thumb screw is required to hold the arms. In the example of FIGS. 1 through 3 the sliding arms are flat battens of wood or similar material. The sides of the brackets 14 and 16 are lined with leather linings 22 for a secure but slideable frictional fit of the battens 18 and 20 within the sockets or brackets 14 and 16. The frictional fit of the battens 18 and 20 however permits sliding motion in the elongate direction of the battens 18 and 20 for measuring spaces and spans as hereafter described. The elongate gauge arms or battens 18 and 20 are in parallel with each other and at right angles to the frame cross arm 12.

The brackets 14 and 16 are formed with reference edge projections 24 and 26 respectively extending below the bottom of the bracket. The projections 24 and 26 define a reference edge for placement against a working reference line such as a row of installed tiles. Typically the working reference line is the second to last row of tiles and the gauge is used for measuring the span or space to a finishing edge or boundary for cutting and installing the last or final row of tiles. Thus, the battens 18 and 20 are slideably adjusted within the brackets 14 and 16 for parallel and independent measurement of the distances from the reference edge and working reference line such as the row of installed tiles to the boundary or finishing line at 2 spaced apart locations.

An abutment edge or butting edge 32 is defined in spaced relationship to and above the reference edge by an abutment panel 30 mounted on the frame cross arm 12. The panel 30 defines a butting edge 32 for positioning a row of tiles to be scored. The abutment panel 30 is adjustably mounted for variable positioning of the butting edge 32 in relation to the reference edge defined by reference projections 24 and 26. By adjustment of the butting edge 32 a tile grout line of desired width may be set for the last row of tiles to be cut and installed. The position of the abutment panel 30 to achieve a desired grout line width is set by loosening screws 38, 40 and translation of the panel 30. Screws 38 and 40 are reset and the specified grout line width is set for the entire job.

The cross arm frame 12 forms a raised bridge or bridge handle across the gauge between the brackets and the abutment panel 30 is adjustably mounted on the frame cross arm below the bridge handle 12 and above the brackets 14 and 16. The abutment panel 30 is formed with parallel spaced apart slots 34 and 36 while the frame cross arm or bridge handle 12 includes the screws or bolts 38 and 40 for securing the abutment panel 30 to the frame cross arm 12 at the desired positioning in relation to the reference edge, setting the grout line width specified for a job.

The gauge arms or battens 18 and 20 are formed with spacer pins 42 under the end of each sliding batten for spacing the gauge arm from a surface above tile adhesive which has been applied to the surface. The gauge arms 18 and 20 are also formed with holes 44 and 46 respectively at the ends of the battens for coupling to a tile cutter as hereafter described so that the tile spacing gauge 10 forms an integral component of the tile cutter for holding tiles in position for scoring by the tile cutter.

Figure 5:
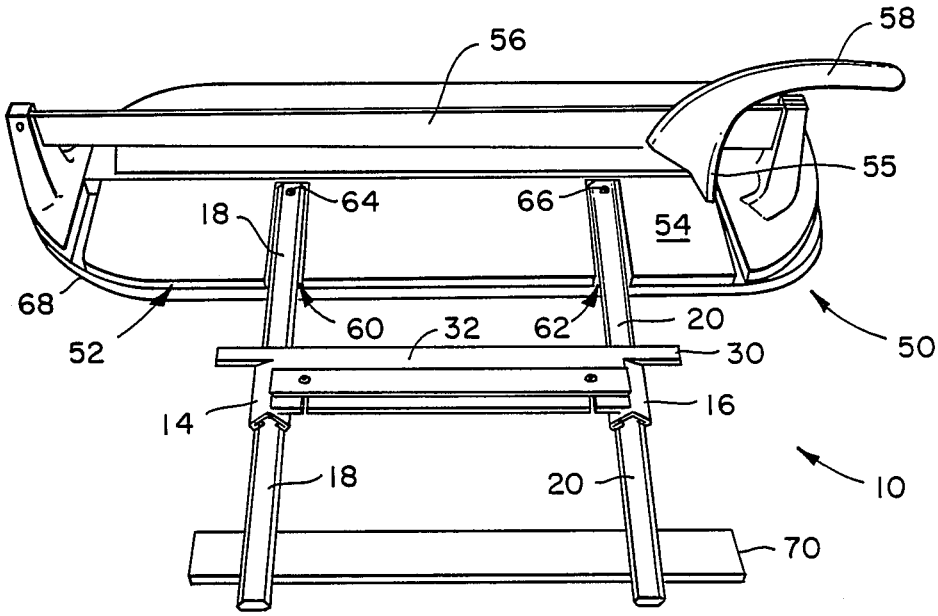
FIG. 5 is an environmental perspective view showing the tile spacer gauge and tile holder coupled in place on a tile cutter and forming an integral component of the tile cutter.

An environmental perspective view of the tile spacing gauge 10 coupled in operative position on a tile cutter 50 is shown in FIG. 5. The tile cutter 50 is a standard tile cutter or tile cutting apparatus, available for example from the Superior Tile Cutter Company of 1556 W 134th St., Gardena, California.

The tile cutter is formed with a flat panel tile cutting surface 52 lined with a resilient pad 54. Tile scoring for cutting the tile is accomplished by a wheel cutter or tile cutting knife 55 mounted on a guide or slide 56 over the tile cutting surface 52 on which the tiles are placed for scoring. The tile scoring knife 55 is provided with a handle 58 for operating and moving the knife across the guide or slide 56 to affect a score line across the tiles resting on the working plane or surface 52.

According to the present invention the conventional tile cutter 50 is modified or retrofitted by cutting 2 channels 60 and 62 in the resilient pad or lining 54 to receive the gauge arms 18 and 20 flush with or below the working surface of the resilient pad 54. Furthermore, at the end of each channel 60 and 62 coupling pins, posts or knobs 64 and 66 are secured by for example bolting into the base frame or plate 68 of tile cutter 50 for receiving the coupling holes 44 and 46 at the ends of the gauge arm battens 18 and 20. A riser 70 can be placed under the opposite end of the gauge 10 to provide uniform elevation of the gauge relative to the tile cutting surface 52.

In operation of the tile spacing gauge, the gauge arms or battens 18 and 20 have already been set to gauge the span between the reference line of the second to last row of installed tiles and the boundary or finish line reflecting the space or span available for the last row of tiles to be installed. Furthermore the butting edge 32 has been set relative to the reference edge defined by the reference edge projections 24 and 26 on the under surface of the brackets 14 and 16 for defining the desired grout line width specified for the particular tiling job. This setting gives consistently the same width grout line throughout the tiling job. The tiles to be scored by the tile cutter 50 are then placed on the tile cutting surface 52 with edges abutting against the butting edge 32. The tiles are cut with a width gauged by the elongate gauge arms automatically taking into account the final span distance and the desired width of the grout line. In this manner the tile spacing gauge 10 also functions as a tile holder automatically positioning the tiles for scoring and accurately fitting the tiles in the final span or space without the step of actually measuring and marking the tiles or having to follow a marked line.

While the invention has been described with reference to particular example embodiments it is intended to cover all variations and equivalents within the scope of the following claims.

I claim:

1. A tile spacing gauge and tile holder comprising:

an elongate frame cross arm comprising first and second brackets spaced apart at either end of the cross arm, said brackets being constructed and arranged for slideably receiving elongate gauge arms in parallel with each other and at right angles to the frame cross arm, said brackets being formed with reference edge means for placement against a working reference line such as a row of installed tiles;

first and second elongate gauge arms slidably mounted in the respective first and second brackets with gauge arm ends slideably projecting from the brackets for parallel and independent measurement of the distances from the reference edge means and working reference line to a boundary or finishing line at two spaced apart locations by slidably positioning the gauge arms;

abutment means adjustably mounted on the frame cross arm defining a butting edge in spaced relation to the reference edge means for setting the desired width of a grout line and for positioning a row of tiles to be scored;

and coupling means for coupling the tile spacing gauge to a tile cutter so that the tile spacing gauge can form a component of the tile cutter after measurement positioning of the gauge arms for holding tiles in position at the butting edge for scoring and cutting by the tile cutter along a line set by the positioning of the respective gauge arms, said coupling means being positioned at the ends of said elongate gauge arms and further comprising adapter means to be secured on the tile cutter for mounting the tile spacing gauge on the tile cutter at the ends of the gauge arms.

2. The tile spacing gauge and tile holder of claim 1 wherein the abutment means comprises an abutment panel adjustably mounted on the frame cross arm for variable positioning of the butting edge in relation to the reference edge means for accommodating and setting a tile grout line of desired width upon scoring and cutting of tiles.

3. The tile spacing gauge and tile holder of claim 2 wherein the abutment panel is formed with parallel spaced apart slots and wherein the frame cross arm comprises bolt means for securing the abutment panel to the frame cross arm at the parallel slots.

4. The tile spacing gauge and tile holder of claim 1 wherein the elongate gauge arms are formed with spacer means under the end of each gauge arm for spacing the gauge arm from a surface above tile adhesive applied to the surface.

5. The tile spacing gauge and tile holder of claim 1 wherein the reference edge means comprise projections from the bottom of the first and second brackets.

6. The tile spacing gauge and tile cutter of claim 1 wherein the adapter means comprises pin or post means to be secured to a tile cutter for receiving the tile spacing gauge and wherein the ends of the gauge arms are formed with holes for placement of the ends of the gauge arms over the post means.

7. The tile spacing gauge and tile holder of claim 1 wherein the elongate frame cross arm comprises a bridge between the first and second brackets forming a handle for the tile spacing gauge.

8. The tile spacing gauge and tile holder of claim 7 wherein the abutment means comprises an elongate abutment panel adjustably mounted on the frame cross arm below the bridge handle and above the brackets, said abutment panel being adjustable for varying the position of the butting edge in relation to the reference edge means for accommodating and setting a tile grout line of desired width during scoring and cutting of tiles.

9. A tile spacing gauge and tile holder comprising:

an elongate frame cross arm comprising first and second brackets mounted at either end of the cross arm, said cross arm comprising a bridge handle extending between the brackets, said brackets being oriented at right angles to the bridge handle and being constructed and arranged for slideably receiving elongate gauge arms in parallel with each other and at right angles to the bridge handle, said brackets being formed with reference edge projections below the brackets for placement against a working reference line such as a row of installed tiles;

first and second elongate gauge arms frictionally and slideably mounted in the respective first and second brackets with gauge arm ends slideably projecting from the brackets for parallel and independent measurement of the distances from the reference edge projections and reference working line to a finishing line or boundary at two spaced apart locations by slideably positioning the gauge arms;

an abutment panel adjustably mounted on the frame cross arm defining a butting edge in spaced relation to the reference edge projections and for positioning tiles to be scored, said abutment panel being adjustably mounted on the frame cross arm for variable positioning of the butting edge in relation to the reference edge projections for accommodating and setting a tile grout line of desired width during scoring and cutting of tiles;

and coupling means formed at the end of the gauge arms for coupling the tile spacing gauge to a tile cutter so that the tile spacing gauge forms a component of the tile cutter for holding tiles in position at the butting edge for scoring and cutting by the tile cutter along a line set by the positioning of the respective gauge arms, said coupling means being positioned at the ends of said elongate gauge arms and further comprising adapter means to be secured on the tile cutter for mounting the tile spacing gauge on the tile cutter at the ends of the gauge arms.

10. The tile spacing gauge and tile holder of claim 9 wherein the elongate gauge arms are formed with spacer means under the end of each gauge arm for spacing the gauge arm from a surface above tile adhesive applied to the surface.

11. The tile spacing gauge and tile holder of claim 9 wherein the elongate abutment panel is adjustably mounted below the bridge handle and above the brackets.

12. The tile spacing gauge and tile holder of claim 11 wherein the elongate abutment panel is formed with parallel slots and the bridge handle comprises bolt means for securing the abutment panel to the bridge handle at the parallel slots.

13. A tile spacing gauge and tile holder comprising:

frame means defining reference edge means for placement against a working reference line such as a row of installed tiles;

elongate gauge means slideably mounted on the frame means for measurement of distance from the reference edge means and working reference line to a finishing line or boundary by slideably positioning the gauge means said elongate gauge means comprising first and second elongate gauge arms slideably mounted at spaced apart locations on the frame means with gauge arm ends slideably projecting from the frame means, said gauge arms being parallel for parallel and independent measurements at spaced apart locations;

abutment means formed on the frame means defining a butting edge in spaced relation to the reference edge means for positioning tiles to be scored;

and coupling means for coupling the tile spacing gauge to a tile cutter so that the tile spacing gauge can form a component of the tile cutter for holding tiles in position at the butting edge for scoring by the tile cutter along a line defined by the positioning of the gauge means said coupling means comprising coupling elements at the ends of the gauge arms for coupling the tile spacing gauge to a tile cutter at the ends of the elongate gauge arms so that the tile spacing gauge functions as a tile holder on a tile cutter and further comprising adapter means to be secured on the tile cutter for mounting the tile spacing gauge on the tile cutter at the ends of the gauge arms.

14. The tile spacing gauge and the tile holder of claim 13 wherein the abutment means is adjustably mounted on the frame means for variable positioning of the butting edge in relation to the reference edge means for accommodating and setting a tile grout line of desired width upon scoring and cutting of tiles.

* * * * *